US005858600A

United States Patent [19]

Itakura et al.

[11] Patent Number: 5,858,600

[45] Date of Patent: Jan. 12, 1999

[54] METHOD OF CONTROLLING ELECTRIC CHARGE OF A TWO-COMPONENT DEVELOPING AGENT

[75] Inventors: Takayuki Itakura; Hiroaki Masuda, both of Osaka, Japan

[73] Assignee: Mita Industrial Co., Ltd., Osaka, Japan

[21] Appl. No.: 856,284

[22] Filed: May 14, 1997

[30] Foreign Application Priority Data

May 14, 1996 [JP] Japan ..... 8-159290

[51] Int. Cl.[6] ..... G03G 21/00

[52] U.S. Cl. ..... 430/137; 361/226

[58] Field of Search ..... 430/137; 361/226

[56] References Cited

U.S. PATENT DOCUMENTS

| | | | |
|---|---|---|---|
| 4,450,220 | 5/1984 | Haneda et al. | 361/226 |
| 4,621,039 | 11/1986 | Ciccarelli et al. | 430/137 |
| 5,213,935 | 5/1993 | Shimizu et al. | 430/137 |
| 5,275,904 | 1/1994 | Shimizu et al. | 430/137 |
| 5,633,108 | 5/1997 | Christy et al. | 361/226 |
| 5,674,656 | 10/1997 | Maniar | 430/137 |

FOREIGN PATENT DOCUMENTS

| | | | |
|---|---|---|---|
| 56-150775 | 11/1981 | Japan | 361/226 |

*Primary Examiner*—Roland Martin
*Attorney, Agent, or Firm*—Sherman and Shalloway

[57] ABSTRACT

A toner and a carrier are so combined together as to substantially satisfy the following formula (1), $$Q\max = \frac{K \times V_{T/C}}{1 + (\tau g/\tau r)} \quad (1)$$

wherein Qmax is a maximum amount of electric charge ($\mu$C/g) of the toner, $V_{T/C}$ is a contact potential difference (V) of the toner to the carrier, $\tau$r is a relaxation time constant (sec) of the toner, $\tau$g is a charging time constant (sec) of the toner, and k is a coefficient (F) determined depending upon the kinds of the toner and the carrier. This method makes it possible to so combine the toner and the carrier together that the amount of electric charge of the two-component developing agent becomes a maximum based on the contact potential difference ($V_{T/C}$) of the toner to the carrier.

4 Claims, 11 Drawing Sheets

RELATIONSHIP BETWEEN THE MAX SPECIFIC CHARGE OF A MODEL TONER AND CPD OF THE TONER TO THE CARRIER PARTICLES

CHANGES IN THE SPECIFIC CHARGES OF THE MODEL TONERS WITH THE PASSAGE OF TIME (sec).

RELATIONSHIP BETWEEN THE CHARGING TIME CONSTANT AND THE COMPRESSIBILITY

DEVICE FOR MEASURING THE SPECIFIC CHARGE

SEM PHOTOGRAPHS OF SAMPLE POWDERS (MODEL TONERS)

Before Mechanical Treatment R=0.05

After Mechanical Treatment R=0.05

SEM PHOTOGRAPHS OF SAMPLE POWDERS (MODEL TONERS)

Before Mechanical Treatment R=0.15

After Mechanical Treatment R=0.15

RELATIONSHIP BETWEEN THE TIME CONSTANTS AND THE MASS FRACTION OF ADDED GUEST PARTICLES

RELATIONSHIP BETWEEN THE CPD OF A MODEL TONER TO Au AND THE MASS FRACTION R OF ADDED GUEST PARTICLES

METHOD OF CONTROLLING ELECTRIC CHARGE OF A TWO-COMPONENT DEVELOPING AGENT

BACKGROUND OF THE INVENTION

1. Field of the Invention

The present invention relates to a method of controlling electric charge of a toner and, particularly, to a method of controlling electric charge of a toner by selecting a combination of a toner and a carrier by utilizing a contact potential difference between the toner and the carrier.

2. Description of the Prior Art

Accompanying a rapid development in the information technology on a global scale in recent years, copying machines, facsimiles and printers are growing as output units which are indispensable in the information network society. Many of these information equipment are applying an electrophotographic process by utilizing electric charge due to friction of particles. In the industries of manufacturing leading devices such as in the manufacture of semiconductors and liquid crystal displays which are the key devices mounted on the information equipment and affect performance thereof and in the manufacture of medical products, on the other hand, the electrically charged particles adhere to the devices and to the tubular walls to adversely affect the quality of the final products. In any way, at present, it has been urged in various fields of industries to forward basic studies for controlling electrically charging properties of the particles.

The electrophotographic process can be roughly divided into a one-component developing system and a two-component developing system depending upon the system for electrically charging the toner which is a powdery ink used for developing electrostatic latent image. In the one-component developing system, the electric charge is generated by bringing the toner into pressed contact with a blade of a metal or a rubber. In the two-component developing system, the electric charge is generated by stirring and mixing the toner and carrier particles of iron or ferrite. In either system, it is the most important object to control the amount of electric charge of the toner to lie within a predetermined range to obtain a vivid copy image.

At present, however, no method has yet been established to quantitatively evaluate the electrically charging properties of the toner, and a method (blow-off method) has chiefly been employed to measure a specific charge that generates when the toner and the carrier particles are electrically charged by friction.

The above-mentioned conventional method, however, is capable of experimentally finding the amount of electric charge for a particular combination of the toner and the carrier only, but is not capable of estimating the amount of electric charge for a wide range of combinations of the toner and the carrier maintaining precision.

Here, a contact potential difference specific to a substance is drawing wide attention as a property for quantitatively measuring the electric charge of the toner, and studies have been vigorously conducted.

The contact potential difference will now be described. When a substance and another substance come in contact, in general, a potential difference occurs on the interface. The potential difference differs depending upon the kind of the substance and the surface state. The potential difference on the interface is called contact potential difference. If a work function on the surface of a substance A is denoted by $Ø_A$ and a work function on the surface of a substance B by $Ø_B$, the contact potential difference $V_O$ is expressed by the formula (6), $$V_O=-(Ø_A-Ø_B)/E \tag{6}$$

where e is an elementary electric charge ($1.6\times10^{-19}$ C).

According to studies reported so far, however, the sample toner is formed in the form of a plate, or correlation to the amount of electric charge (specific charge) is, in many cases, studied by quoting values disclosed in the literatures. Such methods may indicate a tendency of electric charge but never makes it easy to correctly predict the amount of electric charge and never makes it possible to select a combination of a toner and a carrier in relation to the required amount of electric charge.

SUMMARY OF THE INVENTION

The present inventors have discovered the fact that a maximum amount of electric charge produced by friction between the toner and the carrier in the two-component developing agent is intimately related to a contact potential difference $V_{T/C}$ between the two, and is further related to a relaxation time constant (τr) and a charging time constant (τg) of the toner. The inventors have further discovered the fact that the charge rising property of the toner is related to the relaxation time constant (τr) of the toner and to a compressibility (C) of the toner or to the charging time constant (τg) of the toner. The inventors have further learned that the charge stability of the toner is related to the relaxation time constant (τr) of the toner.

That is, the object of the present invention is to provide a method of controlling electric charge of a two-component developing agent, which is capable of determining a combination of a toner and a carrier to accomplish a predetermined maximum amount of electric charge based upon a contact potential difference ($V_{T/C}$) of the toner to the carrier.

Another object of the present invention is to provide a method of controlling electric charge of a two-component developing agent, which is capable of obtaining a desired charge rising property of the toner based upon a relaxation time constant (τr) of the toner and the compressibility of the toner.

A further object of the present invention is to provide a method of controlling electric charge of a two-component developing agent, which is capable of obtaining a desired charge stability of the toner based upon the relaxation time constant (τr) of the toner.

A still further object of the present invention is to provide a method of controlling electric charge of a two-component developing agent, which is capable of obtaining a desired combination of the amount of electric charge, rising property and charge stability.

According to the present invention, there is provided a method of controlling electric charge of a two-component developing agent by electrically charging the two-component developing agent relying upon friction between a toner and a carrier, wherein the toner and the carrier are so combined together as to substantially satisfy the following formula (1), $$Q\max = \frac{K \times V_{T/C}}{1 + (\tau g/\tau r)} \tag{1}$$

or, when τg/τr<<1, as to substantially satisfy the following formula (2), $$Qmax=k\times V_{T/C} \tag{2}$$

where Qmax is a maximum amount of electric charge ($\mu$C/g) of the toner, $V_{T/C}$ is a contact potential difference (V) of the toner to the carrier, $\tau r$ is a relaxation time constant (sec) of the toner, $\tau G$ is a charging time constant (sec) of the toner, and k is a coefficient (F) determined depending upon the kinds of the toner and the carrier.

According to the present invention, furthermore, there is provided a method of controlling electric charge of a two-component developing agent by electrically charging the two-component developing agent relying upon friction between a toner and a carrier, wherein the toner is so selected as to substantially satisfy the following formula (3), $$\Delta Q = Q\max \times \left( \frac{1}{\tau R} + \frac{1}{aC + b} \right) \tag{3}$$

or the following formula (4), $$\Delta Q = Q\max \times \left( \frac{1}{\tau r} + \frac{1}{\tau g} \right) \tag{4}$$

where $\Delta Q$ is a charge rising property ($\mu C \times g^{-1} \times sec^{-1}$) of the toner, $\tau r$ is a relaxation time constant (sec) of the toner, C is a compressibility (%) of the toner as measured by using a powder tester, Qmax is a maximum amount of electric charge ($\mu$C/g) of the toner, a and b are constants determined depending upon the kinds of the toner and the carrier, and $\tau g$ is a charging time constant (sec) of the toner.

According to the present invention, furthermore, there is provided a method of controlling electric charge of a two-component developing agent by electrically charging the two-component developing agent relying upon friction between a toner and a carrier, wherein the toner is so selected that a decrease Q in the amount of electric charge when t seconds have passed from the start of friction substantially satisfies the following formula (5), $$Q \leqq Q\max \times \exp\left( -\frac{t}{\tau r} \right) \tag{5}$$

where Qmax is a maximum amount of electric charge ($\mu$C/g) of the toner and $\tau r$ is a relaxation time constant (sec) of the toner.

DETAILED DESCRIPTION OF THE INVENTION

As mentioned already, the present invention is based on a new discovery that a maximum amount of electric charge Qmax of a two-component developing agent of when a toner and a carrier are electrically charged by friction, varies depending upon the contact potential difference $V_{T/C}$ of the toner to the carrier and upon a relaxation time constant $\tau r$ and a charging time constant $\tau g$ of the toner, and is determined in compliance with the above-mentioned formula (1) or (2). When the relaxation time constant $\tau r$ of the toner is considerably greater than the charging time constant $\tau g$ (which generally holds true), the above-mentioned formula (1) can be regarded to be $$1 + \left( \frac{\tau g}{\tau r} \right) = 1$$

and, hence, the above-mentioned formula (2) holds.

In the two-component developing agent, there exists additive property between the contact potential difference of the toner and the contact potential difference of the carrier. Therefore, the contact potential difference $V_{T/C}$ of the toner to the carrier is expressed by the formula, $$V_{T/C} = V_{T/Au} - V_{C/Au} \tag{7}$$

where $V_{T/Au}$ is a contact potential difference (V) between the electrode and the toner, and $V_{C/Au}$ is a contact potential difference (V) between the Au electrode and the carrier.

The coefficient k in the above-mentioned formula (1) or (2) can theoretically be obtained from the following formula (8), $$k = \frac{\pi \epsilon_O Dp^2}{2Zo} \tag{8}$$

where Dp [m] is the particle diameter of the toner, and Zo [m] is a separation distance between the toner particles and the carrier particles when both are contacted with each other, and is, usually, about 0.4 nm.

Besides, the coefficient k remains constant between a predetermined carrier and a toner which includes a predetermined charge control surface layer. Therefore, the coefficient k can be experimentally found from a relationship between the contact potential difference and the maximum amount of electric charge. This also holds in a relationship between a predetermined toner and a carrier having a predetermined resin-coated layer.

Figure 1:
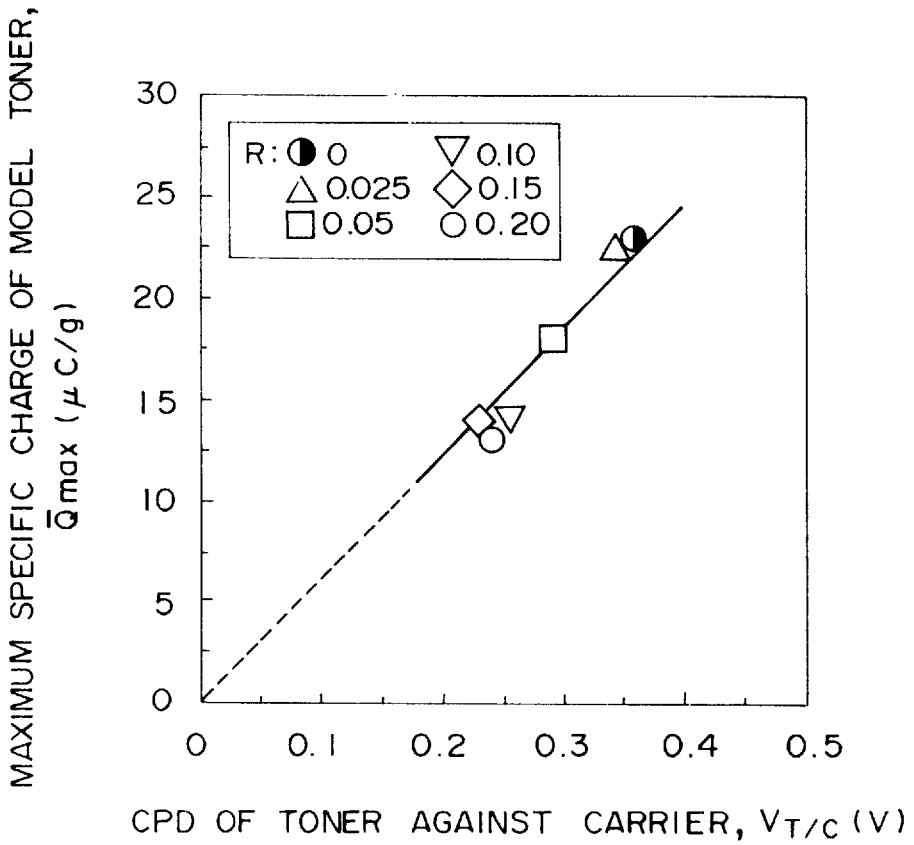
FIG. 1 is a graph illustrating a relationship between the maximum amount of electric charge Qmax of a toner and a contact potential difference of the toner to the carrier particles.

FIG. 1 is a diagram plotting a relationship between the contact potential difference $V_{T/C}$ and the maximum amount of electric charge Qmax in a predetermined carrier and toners coated with the same resin respectively as (but the amount of coating is different), from which it will be understood that each plot is positioned on a straight line passing through origin and having a gradient K.

Thus, when the carrier used in the two-component developing agent is specified and the kind of the toner resin or of the charge control agent that is used is specified, then, a contact potential difference $V_{T/Au}$ of the toner that gives a predetermined maximum amount of electric charge can be easily found from a maximum required amount of electric charge Qmax, the contact potential difference $V_{C/Au}$ of the predetermined carrier and the coefficient k, and whereby the recipe of the toner composition and the particles can be easily designed. Furthermore, when the toner that is used is specified and the kinds of the magnetic core and the coating resin of the carrier are specified, then, a contact potential difference $V_{C/Au}$ of the carrier that gives a predetermined maximum amount of electric charge can be easily found from a maximum required amount of electric charge Qmax, the contact potential difference $V_{T/Au}$ of the predetermined toner and the coefficient k, whereby the carrier-coating layer can be easily designed.

Conversely, when the contact potential difference $V_{T/Au}$ of the toner and the contact potential difference $V_{C/Au}$ of the carrier are learned, a maximum amount of electric charge Qmax of the two-component developing agent can be estimated.

In the ordinary toner, the relaxation time constant τr is considerably larger than the charging time constant τg (τg/τr<<1) and, hence, the above-mentioned formula (2) is useful to a sufficient degree. However, when a value τg/τr is no longer negligible compared with 1, the maximum amount of electric charge Qmax and the contact potential difference $V_{C/Au}$ of the carrier or the contact potential difference $V_{T/Au}$ of the toner may be found from the above-mentioned formula (1) by taking the relaxation time constant τr and the charging time constant τg of the toner into consideration.

The relaxation time constant τr for charging the toner can be easily calculated from the formula (8), $$\tau r = \epsilon_a \times \rho_A \tag{8}$$

by measuring the apparent dielectric constant $\epsilon_a$ ($Fm^{-1}$) and the resistivity $\rho_a$ (Ωm) of the toner.

On the other hand, the charging time constant τg of the toner can theoretically be found from the following formula (9), $$\tau g = \frac{\pi Dp^2 \tau_{gO}}{2Sf\Delta t} \tag{9}$$

where Dp [m] is a particle diameter of the toner, S [$m^2$] is a contact area, f [$s^{-1}$] is a frequency of contact between the toner particles and the carrier particles, Δt [s] is a contact time, and $\tau_g O$ [s] is a charging time constant representing the migration rate of electron through one time of contact, or can be found through experiment from a curve of electric charge of the toner.

Figure 2:
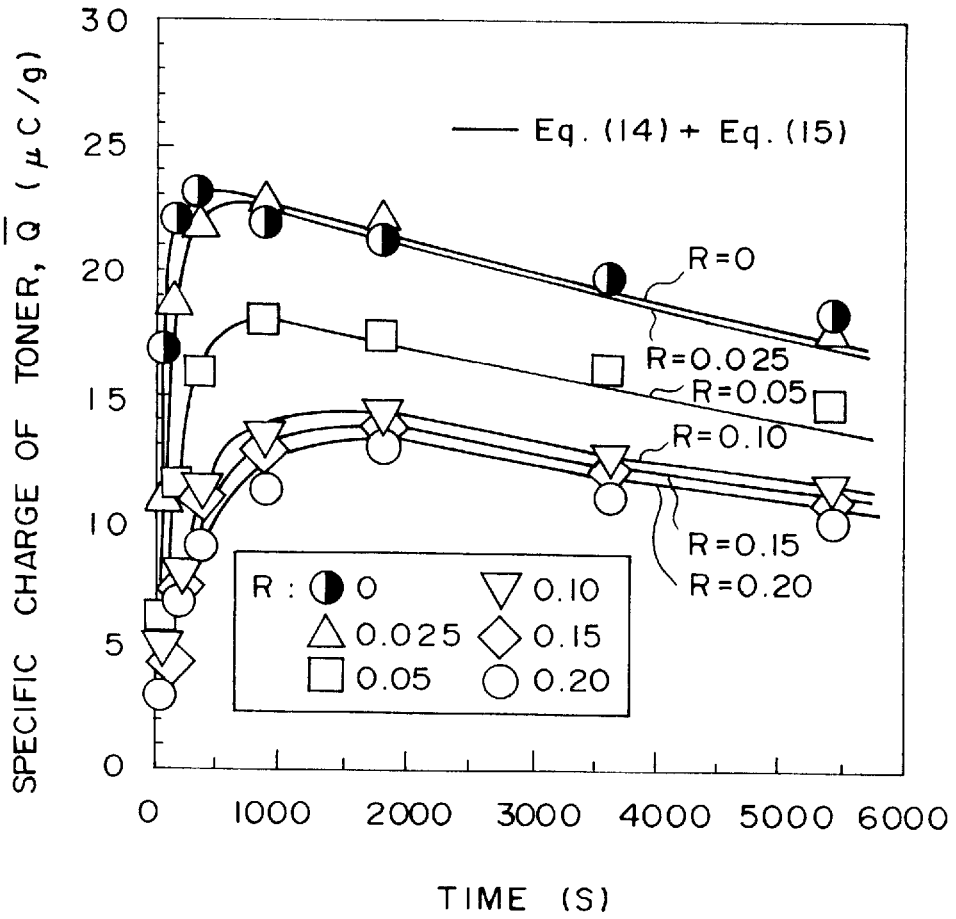
FIG. 2 is a graph plotting values calculated according to formulas (14) and (15) to represent changes in the specific charges of the toners with the passage of time.

FIG. 2 illustrates a change in the specific charge Q [μC/g] of the toner of an Example that will be described later with the passage of the friction time t. It will be understood that the toners acquire maximum values Qmax [μC/g] after the passage of predetermined periods of time and then the values decrease. Solid lines in FIG. 2 are drawn by plotting calculated values that will be described later.

It is now presumed that the toner and carrier particles are electrically charged upon repeating the contact and separation, but the contact and separation of the particles relative to the container are negligible since the total area of the inner wall of the container is very small relative to the specific surface areas of the particles. Here, the following formula (10) can be obtained if the electric charge of a toner particle which is in contact with the carrier particles is considered in the same manner as that of the case of the intratubular solid-gas two-phase stream that was reported earlier, $$\frac{dQ}{dt} = \frac{k \times V_{T/C}}{\tau g} - \frac{Q}{\tau g} \tag{10}$$

If it its presumed that the relaxation also takes place in the electric charge, the electric charge of a toner particle decreases according to the following formula (11) (exponential law), $$\frac{dQ}{dt} = -\frac{Q}{\tau r} \tag{11}$$

When the step of charging and the step of relaxation proceed simultaneously, the charging rate of the toner is expressed by the following formula (12), $$\frac{dQ}{dt} = \frac{k \times V_{T/C}}{\tau g} - Q\left(\frac{1}{\tau g} + \frac{1}{\tau r}\right) \tag{12}$$

The above formula (12) is integrated to obtain the following formula (13), $$Q = \frac{kV_{T/C}}{1 + \left(\frac{\tau G}{\tau r}\right)}\left[1 - \exp\left(-\left(\frac{1}{\tau g} + \frac{1}{\tau R}\right)t\right)\right] \tag{13}$$

According to the above-mentioned formula (13), the amount of electric charge reaches a saturated state with the passage of time. According to the results of experiment shown in FIG. 2, on the other hand, the amount of electric charge reaches a maximum after the passage of a predetermined period of time and then gradually decreases. This is because, the above-mentioned formula (13) is based on the case where the carrier particles and the toner are electrically charged upon repeating the contact and separation endlessly without taking a change in the frequency of contact f [$s^{-1}$] into consideration. In practice, however, the charged toner gradually adheres to the peripheries of the carrier particles to prevent effective contact.

Therefore, the step of electrically charging the two-component developing agent is divided into a time region until Q [μC/g] reaches a maximum value (region I) and a subsequent time region (region II). The region I is a time zone in which the toner and carrier particles repeat contact and separation at a frequency of contact f [$s^{-1}$], and the region II represents a state where the toner is completely adhered to the peripheries of the carrier particles and where the frequency of contact f [$s^{-1}$] is zero. In practice, the frequency of contact f [$s^{-1}$] will gradually change in the region I but is here treated as a mean constant. In this case, a curve of electric charge in the region I is represented by the following formula (14), $$Q = Q\max\left[1 - \exp\left(-\left(\frac{1}{\tau g} + \frac{1}{\tau r}\right)t\right)\right] \tag{14}$$

In the region II, τg[s] in the formula (13) becomes an infinity since f=0 and no electric charge is generated. Therefore, the curve of the electric charge is represented by the formula (15), $$Q \leqq Q\max \times \exp\left(-\frac{t}{\tau r}\right) \tag{15}$$

In FIG. 2, the solid lines represent the results of calculation according to the formulas (14) and (15), from which it will be understood that a model formula of electric charge which takes the frequency of contact between the toner and the carrier particles into consideration, is in good agreement with the experimental results.

The results of FIG. 2 and formula (14) tell that the charge rising property of the toner is given by the above-mentioned formula (4). That is, the rise of the toner becomes more steep with a decrease in the charging time constant $\tau g$ of the toner.

Concerning a required maximum amount of electric charge Qmax and charge rising property of the toner, when $\tau g/\tau r<<1$, a charging time constant $\tau g$ of the toner to be selected can be determined. Conversely, when a relaxing time constant $\tau r$ and charging time constant $\tau g$ of the toner are learned, the charge rising property of the toner can be estimated.

It was further learned that the charge rising property of the toner complies with the above-mentioned formula (3). The charging time constant $\tau g$ [s] is related to the frequency of contact as represented by the above-mentioned formula (9), and its relation to the fluidity of the toner was examined.

Figure 3:
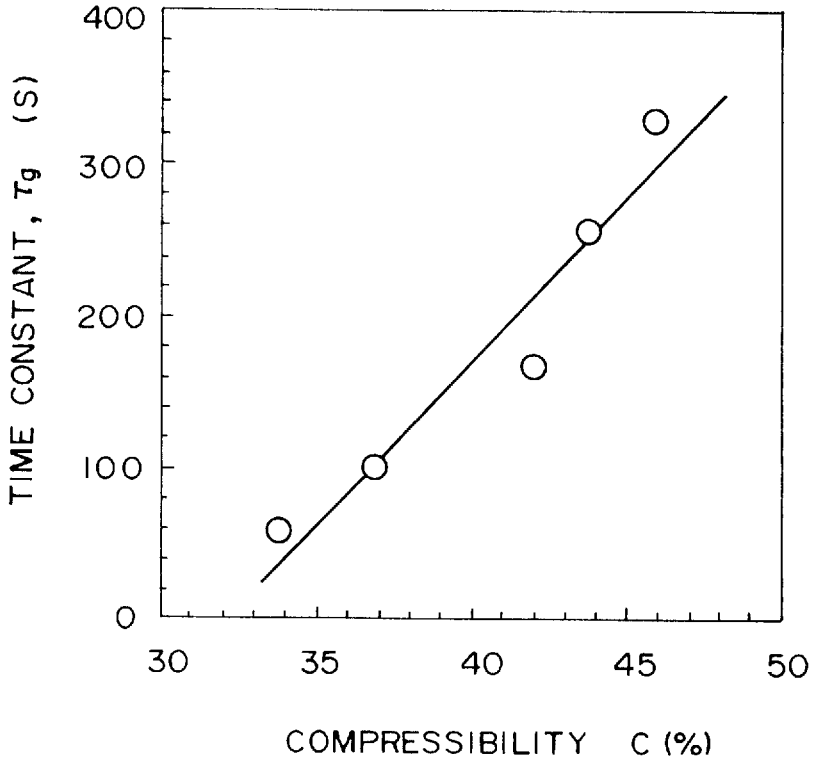
FIG. 3 is a graph illustrating a relationship between the charging time constant $\tau g$ of the toner and the compressibility of the toner.

FIG. 3 illustrates a relationship between the charging time constant $\tau g$ [s] of the toner and the compressibility C [%] which serves as an index of fluidity of the powder as measured by using a powder tester (PT-E manufactured by Hosokawa-Micron Co.). The larger the compressibility, the poorer the fluidity. There exists a good correlation between $\tau g$ [s] and C [%], and a linear relationship represented by the following formula (16), $$\tau g=aC+b \tag{16}$$

approximately holds true. Thus, the formula (3) is obtained from the formulas (16) and (4), and whereby the compressibility C that gives a desired charge rising property is determined, and the charge rising property is estimated from the toner compressibility C.

From the formula (15), furthermore, it will be understood that increasing the relaxation time constant $\tau r$ of the toner is effective in improving the charge stability of the toner.

According to the present invention, the relaxation time constant $\tau r$ of the toner can be selected in compliance with the formula (5) to obtain a desired charge stability or the charge stability of the toner can be determined based upon the relaxation time constant $\tau r$ of the toner.

[Measurement of the Contact Potential Difference]

The contact potential difference is measured by inserting a toner or a carrier as a sample between the vibration electrodes and by finding a contact potential difference of the toner.

To measure the contact potential difference, an upper electrode which is opposed to a lower electrode (gold electrode) that supports the sample from which electric charge is removed, is vibrated in a manner that the distance between the electrodes changes, a voltage is applied across the electrodes to measure a current, and a voltage at which the detection current is zero is found as a contact potential difference of the sample.

Figure 4:
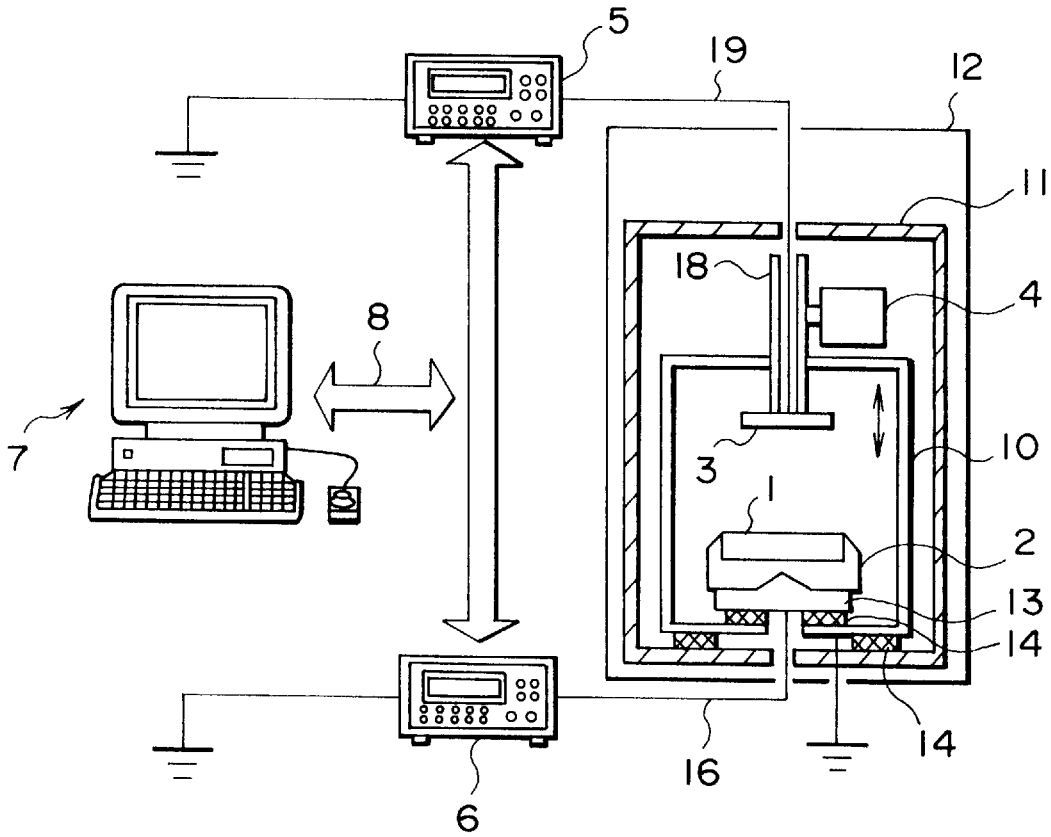
FIG. 4 is a diagram illustrating an electric circuit of a device for measuring a contact potential difference.

Referring to FIG. 4 (diagram of electric circuit) illustrating the principle for measuring the contact potential difference, the device comprises a lower electrode 2 for supporting a sample 1, an upper electrode 3 opposed to the lower electrode, a vibration mechanism 4 for so vibrating the upper electrode that the distance between the electrodes changes, a variable voltage source 5 for applying a voltage across the electrodes, and a digital ammeter (electrometer) 6 for detecting a current flowing across the two electrodes.

In FIG. 4, when the sample 1 is supported on the surface of the lower electrode 2, a potential difference takes place on the interface between the two. That is, the electrons migrate from the side having a small work function toward the side having a large work function, and the substance having the small work function is positively charged and the substance having the large work function is negatively charged. The thus formed potential difference $V_0$ is given by the above-mentioned formula (6).

In the measuring circuit of FIG. 4, a current generated by the vibration of the upper electrode 3 is given by the following formula (17), $$i=\frac{\epsilon_0 S\alpha\omega\left(V-V_{sample/Au}-\frac{\rho_a}{2\epsilon_a}a_1\right)\sin(\omega t)}{\left(a_2(t)+\frac{\epsilon_0}{\epsilon_a}a_1\right)^2} \tag{17}$$

where $a_1$ is a thickness of the toner layer, $\epsilon_a$ is an apparent dielectric constant of the toner layer, S is an area of the upper electrode, $a_2$ is a mean distance between the electrodes, $\rho_a$ is a volume charge density, $V_{sample/Au}$ is a contact potential difference of the sample relative to Au, V is an applied voltage, $\alpha$ is an amplitude of the upper electrode, $\epsilon_0$ is a dielectric constant of the air, and $\omega$ is a number of vibration of the upper electrode.

The generated current i fluctuates accompanying the vibration of the upper electrode. When the amplitude of the generated current is brought to zero by changing the applied voltage V, there exists an applied voltage at which i=0 holds. That is, if the applied voltage V at this moment is regarded to be an apparent contact potential difference V0', the following formula (18) is obtained from the above formula (17), $$V_0'=V_{sample/Au}+\frac{\rho_a}{2\epsilon_a}a_1^2 \tag{18}$$

Here, when the volume charge of the toner layer undergoes the relaxation, the applied voltage is directly measured as a potential difference of the sample relative to Au as given by the following formula (19)

$$V_0=V_{sample/Au} \tag{19}$$

The measuring circuit of FIG. 4 is equipped with a computer 7 for controlling the measurement and an interface (GP-IB interface) 8 which connects the computer to the variable digital power source and the digital ammeter.

The computer 7 for controlling the measurement (i) sets an applied voltage for measurement, steps therefor and the number of points of measurement, (ii) preserves the applied voltage and the detected current, (iii) calculates by integration an electric power as an absolute value based thereupon, and (iv) finds a primary regression concerning the applied voltage and the electric power and calculates the applied voltage at which the electric power becomes zero as a contact potential difference of the toner.

In this device, an application voltage for measurement, steps therefor and the number of points of measurement are set to the computer 7, the voltage applied to the electrodes 2 and 3 from the variable voltage source 5 is automatically changed through the interface 8, and currents fluctuating accompanying the vibration of the upper electrode 3 are taken, at the preset number of measuring points, by the computer from the ammeter 6 through the interface 8. Therefore, many measured values can be precisely taken in by the computer without loss of time.

Furthermore, the applied voltage and the detected current taken in through the interface 8 are preserved in the computer in the form of files, which can be not only utilized for the data analysis that will be described later but also fetched as required to use them for the purpose of checking or comparison.

Here, the electric current that flows across the electrodes becomes an alternating current that fluctuates accompanying the vibration of the upper electrode and varies from positive to negative. Besides, the applied voltage varies between positive and negative. Therefore, absolute values of the sampled voltage and current are found, and are integrated to calculate a value of electric power. This calculation is quickly executed according to an operation program.

Next, the primary regression is found concerning the applied voltage and the electric power, and the applied voltage at which the electric power becomes zero is calculated as a contact potential difference of the toner or the carrier. The results of these operations and data analyses can all be preserved in a file.

In taking a measurement, the current i(t) generated when the applied voltage V is changed is input to the computer through a GP-IB (general port interface bus) concerning many points, e.g., 400 points for a predetermined applied voltage every after a predetermined brief period of time, e.g., every after 8 msec in order to analytically find an application voltage at which the amplitude becomes zero.

Figure 5:
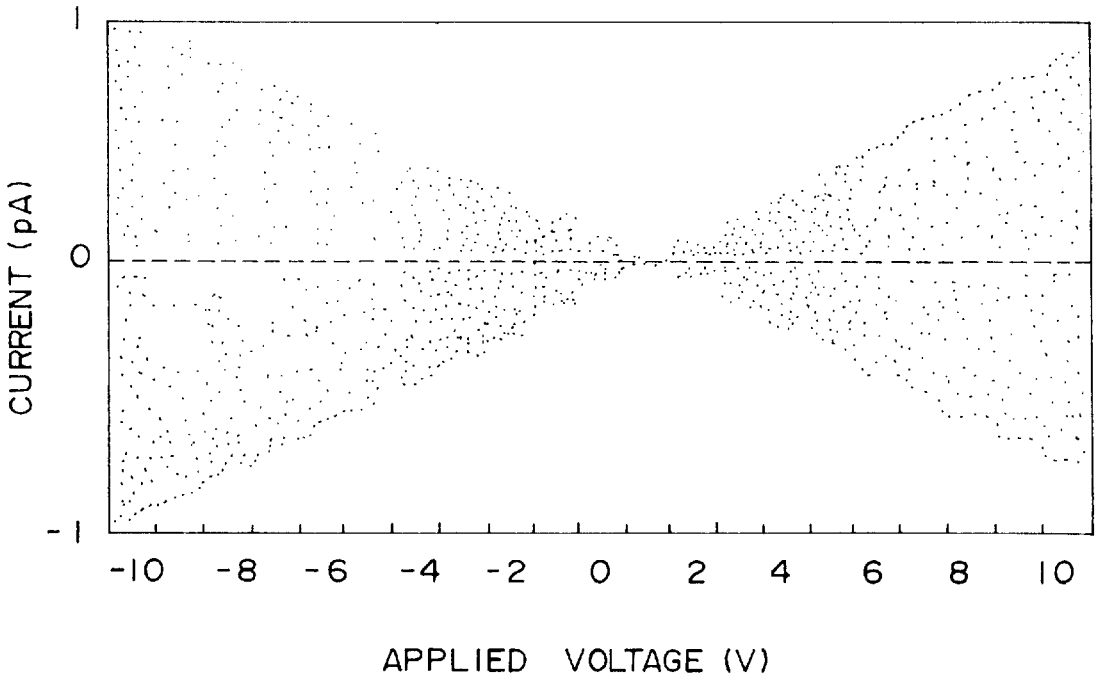
FIG. 5 is a graph of outputs representing a relationship between the applied voltage and the current in the measurement of the contact potential difference.

FIG. 5 shows the results of output of applied voltage—current value by using the computer of when the applied voltage for starting the measurement is—10 V, applied voltage for terminating the measurement is +10 V, step is 1 V, and when a fine acrylic resin powder is used, wherein each dot corresponds to one point of measurement.

Figure 6:
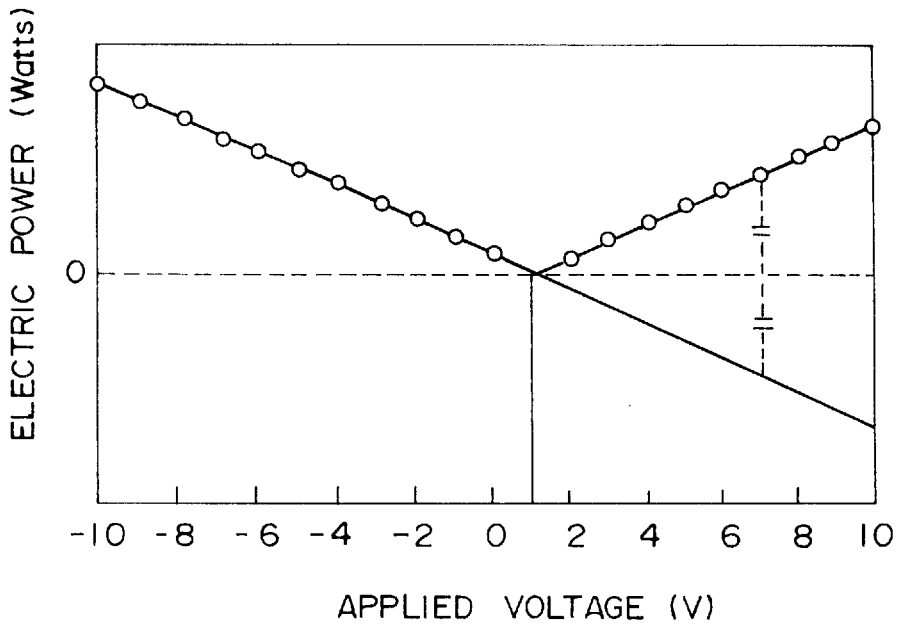
FIG. 6 is a graph of outputs representing a relationship between the applied voltage and the electric power.

FIG. 6 shows the outputs, by using the computer, of when the electric power is calculated, by integration, as an absolute value from the measured values of FIG. 5 and when the primary regression is executed concerning the applied voltage and the electric power. According to the above results, there exist a straight portion of a negative gradient in which the electric power decreases accompanying an increase in the voltage and a straight portion of a positive gradient in which the electric power increases accompanying an increase in the voltage. If the linear portion of a positive gradient is folded with a line at which the electric power becomes zero as a reference, these two linear portions form a perfect straight line. In other words, the folding points of the straight portion of a negative gradient to a straight portion of a positive gradient necessarily exists on a coordinate axis on which the electric power is zero. The correlation of the primary regression is as very high as, for example, 1.00.

Thus, a contact potential difference $V_0$, for example, 1.124 V in FIG. 6 is automatically found as an application voltage at which the electric power becomes zero.

The contact potential difference $V_0$ can be found from the straight portion of a negative gradient and from the straight portion of a positive gradient of FIG. 6. The contact potential difference $V_0$ can be found maintaining a very high precision if the application voltage at which the electric power is zero is found from both straight portions and, particularly, by symmetrically folding one gradient portion relative to the axis of zero electric power.

In this measurement, the time required for measuring a sample (excluding the setting time and the time needed for analyzing the data) is usually from about 180 to about 300 seconds though it may vary depending upon the number of steps for applying the voltage and the points of measurement, and the contact potential difference $V_0'$ can be measured within very short periods of time.

In the measuring device of FIG. 4, a measuring cell 10 contains the lower electrode 2 and the upper electrode 3, the measuring cell 10 being contained in a shield 11 for shielding the measuring cell 10 from the external noise. Furthermore, the shield 11 is contained in a constant-temperature constant-humidity vessel 12 to take measurement under predetermined conditions, i.e., under constant temperature and constant humidity conditions.

Figure 7:
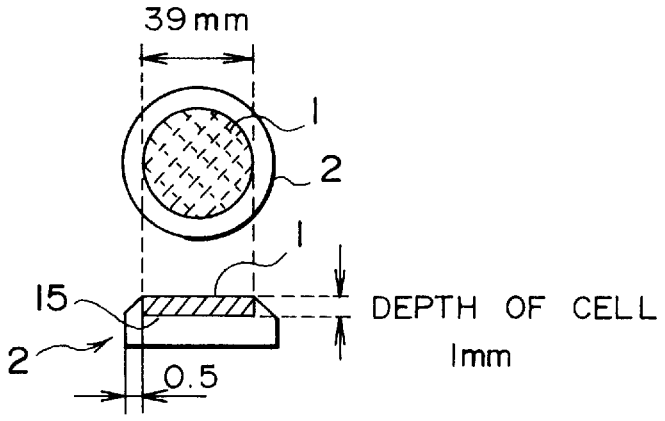
FIG. 7 is a top view and a side view of a lower electrode.

The lower electrode 2 is provided on an electrode support member 13 being electrically connected thereto in a manner that it can be freely detached and being placed in position. The electrode support member 13 is secured to the measuring cell 10 via an insulating member 14. The lower electrode 2 that serves as a cell has a toner layer-filled cell 15 which is recessed from the upper surface thereof by a predetermined depth as shown in FIG. 7, and the cell 15 is filled with a sample toner layer 1 at a predetermined filling rate. It is desired that the measuring surface of the electrode has a diameter of usually from 30 to 50 mm. In this embodiment, the electrode is plated with nickel and has a cell of a diameter of 39 mm and a depth of 3 mm.

The measuring cell 10 and the shield 11 are both grounded, and the electrode support member 13 is connected to a digital ammeter (electrometer) 6 through a cable 16. The connection cable 16 may be an ordinary biaxial cable. However, a highly precise measurement can be accomplished preventing external noise if use is made of a three-wire coaxial cable having a double shield.

A connection cable 19 is extending passing through the support shaft 18 to electrically connect the upper electrode 3 and the variable voltage source 5 together. Desirably, the upper electrode 3 is constituted by a gold-plated plate or the like plate.

The number of vibration and amplitude of the upper electrode 3 can be suitably set, but it is desired that the number of vibration is usually from 60 to 120 rpm (times/min) and the amplitude is from 2.0 to 3.0 mm. In this embodiment, the number of vibration is set to be 72 rpm and the amplitude is set to be 2.5 mm.

In this device, the variable voltage source 5 is controlled and a current value is obtained from the digital ammeter 6 by a computer for controlling the measurement through the GP-IB interface 8.

Any one of contact potential, dielectric constant or electric resistance is selected as an item for measurement. When the contact potential is to be measured, the measuring conditions are set.

First, the number of points of measurement are set for a predetermined voltage. The number of points of measurement is usually from 50 to 500. In this embodiment, the number of points of measurement is 50 in the case of a preliminary testing for determining the range of the applied voltage and is 400 in the case of a main testing.

Next, the measuring range of the voltmeter and the measuring range of the ammeter are set depending upon the kind of the sample and, then, an applied voltage for starting the measurement, an applied voltage for terminating the measurement, and a step voltage (gap width among the voltages) are set and, finally, a file name is input to preserve the measured data.

It is thus ready to start the measurement. As described earlier, vibration of the electrode, application of the voltage and detection of the current are taken in by the computer by a number of points set for every very short periods of time, and this operation is performed for every step voltage until the voltage for terminating the measurement is reached.

The measured data are preserved in a file that is opened, and the results of measurement are displayed on a CRT of the computer being plotted to represent a relationship between the applied voltage and the current value.

The computer 7 analyzes the data according to a program, calculates, by integration, the electric power as absolute values for each of the applied voltages, finds a primary regression concerning the applied voltage and the electric power, calculates the applied voltage at which the electric power becomes zero as a contact potential difference of the toner, and displays the measured results.

[Toner]

The toner which is used in the present invention will be any toner of which the surfaces are at least partly formed of a resin or a resin composition. The toner usually has a particle diameter of from 3 to 17 μm and, particularly, from 5 to 15 μm. Furthermore, the toner particles may assume any shape such as spherical shape, granular shape, dies shape, elliptical shape, cylindrical shape, or irregular shape. The contact potential difference of any of these toners can be found by the above-mentioned method.

A colored toner having an electroscopic property and a stabilizing property is used for the two-component developing agent. The colored toner generally comprises a granular composition obtained by dispersing a pigment, an electrically conducting agent and a charge control agent in a binder resin.

As the binder resin which is a toner component, use is made of a thermoplastic resin or an uncured or a thermosetting resin of an initial condensation product. Suitable examples include aromatic vinyl resins such as polystyrene, as well as styrene-acrylic copolymer resin, acrylic resin, polyvinyl acetal resin, polyester resin, epoxy resin, phenolic resin, petroleum resin and olefin resin.

As the colored pigment, there can be used, for example, carbon black, cadmium yellow, molybdenum orange, Pyrazolone Red, Fast Violet B and Phthalocyanine Blue in one or two or more kinds. The electrically conducting agent will be carbon black in the case of a black toner and will be a tin-containing electrically conducting agent in the case of a colored toner.

As the charge control agent, use is made of a positive charge control agent such as oil-soluble dye like Nigrosine Base (CI 50415), Oil Black (CI 26150) or spiron black and, a negative charge control agent such as metal complex dye, metal naphthenate, metallic soap of fatty acid or resin acid soap.

Instead of using the above-mentioned low-molecular charge control agent, there can be used a copolymerized resin or a resin composition having a cationic polar group or an anionic polar group as at least part of a resin for the toner. Examples of the cationic polar group include basic nitrogen-containing groups such as primary, secondary or tertiary amino group, quaternary ammonium group, amido group, imino group, imido group, hydrazino group, guanizino group or amidino group. Among them, those having amino group or quaternary ammonium group are preferred. Examples of the anionic polar group include carboxylic acid group, sulfonic acid group, sulfinic acid group, phosphonic acid group, phosphinic acid group, or groups of salts thereof, as well as groups having large electronegativity such as halogen atoms.

As the charge control resin, use is made of a resin obtained by polymerizing a monomer containing a cationic or anionic polar group with another monomer or a resin by random copolymerization, block copolymerization or graft copolymerization.

The toner particles may contain a magnetic powder. The magnetic powder to be contained will be any known powder such as tri-iron tetroxide (magnetite), various ferrites or a magnetic metal. It is desired that the magnetic powder has an average particle diameter of generally from 0.1 to 10 μm and, particularly, from 0.1 to 1 μm.

The toner to be used in the present invention may have a composite particle structure. For instance, the composite toner may comprise host particles of a spherical shape having a mass median diameter of from 5 to 15 μm and a settlement layer of guest particles which are fine resin particles that are densely deposited on the surfaces of the host particles and have a mass median diameter of not larger than 0.1 times the diameter of the host particles, the composite toner having a difference in terms of an absolute value between the contact potential difference of the host particles and the contact potential difference of the guest particles of not smaller than 0.01 V and, particularly, not smaller than 0.05 V.

It is desired that the host particles are thermoplastic resin particles obtained by the suspension polymerization of an ethylenically unsaturated monomer, and are usually obtained by subjecting a composition of a monomer and a coloring agent to the suspension polymerization. The thermoplastic resin constituting the host particles is selected out of the above-mentioned resins by taking the fixing property into consideration.

It is desired that the guest particles are fine thermoplastic resin particles obtained by the emulsion polymerization of an ethylenically unsaturated monomer, and the thermoplastic resin constituting the guest particles is selected out of the above-mentioned resins by taking the charge control property into consideration. When the toner has a positively charging property, it is desired that the guest particles are positively charging resin particles. When the toner has a negatively charging property, on the other hand, it is desired that the guest particles are negatively charging resin particles.

It is desired that the host particles (A) and the guest particles (B) exist at a weight-based mixing ratio R=B/A of from $1/10000$ to $1/10$. The densely settled layer is formed by blending them together and subjecting the blend to a mechanical treatment such as shock air stream pulverization.

Onto the toner used in the present invention can be added, from the external side, a fine powder such as of hydrophobic amorphous silica, alumina or titania as a fluidity improving agent in an amount of from about 0.01 to 1% by weight with respect to the toner.

[Carrier]

Any widely known magnetic carrier can be used in combination with the above-mentioned toner such as tri-iron tetroxide (magnetite), various ferrites and iron powder. The magnetic carrier may be magnetic particles, magnetic particles which are coated with a resin, or a binder carrier granulated by binding the magnetic fine particles with a binder resin.

It is desired that the magnetic carrier has an average particle diameter of usually from 20 to 200 μm and, particularly, from 40 to 130 μm and has a saturation magnetization, as measured at 50 KOe, of from 30 to 70 emu/g and, particularly, from 40 to 50 emu/g.

It is desired that the magnetic carrier is coated with a resin. Being coated with the resin, the optimum developing state can be maintained for extended periods of time making it possible to print a strikingly increased number of copies.

Examples of the resins with which the magnetic carrier is to be coated include acrylic resin, styrene-acrylic resin, acrylic-modified silicone resin, silicone resin, epoxy resin, rosin-modified phenolic resin, formaline resin, cellulose resin, polyether resin, styrene-butadiene resin, polyurethane resin, polyvinyl formal resin, melamine resin, polycarbonate resin, and fluorine-contained resins such as ethylene tetrafluoride, etc., which may be used alone or being mixed together in two or more kinds. It is desired that the coating resins have the above-mentioned cationic polar group or anionic polar group in order to control the amount of electric charge. It is desired that the resin component is used in an amount of from 0.1 to 10 parts by weight and, particularly, from 0.2 to 5 parts by weight per 100 parts by weight of the carrier core.

In the binder-type carrier, the above-mentioned magnetic powder is dispersed in the above-mentioned binder resin and it is desired that the magnetic powder is used in an amount of from 100 to 800 parts by weight and, particularly, from 300 to 400 parts by weight per 100 parts by weight of the binder resin. The binder resin may contain a charge control agent.

[Controlling the Electric Charge of the Developing Agent]

The two-component developing agent is electrically charged by friction by filling the developer container with the two-component developing agent which comprises the toner and the carrier, followed by stirring. A maximum amount of electric charge Qmax is controlled by controlling the contact potential difference $V_{T/C}$ of the toner to the carrier in compliance with the above-mentioned formula (1) or (2), i.e., by selecting a toner and a carrier that give a predetermined contact potential difference based upon the additive property of contact potential difference of the formula (7), and combining them together. In this case, there exists a fact that the coefficient k becomes constant in the toner that contains a predetermined kind of resin or charge control agent and in the carrier that has a predetermined magnetic core and a predetermined kind of coating resin. Therefore, the toner can be easily selected and combined.

It is further possible to control the charge rising property $\Delta Q$ of the toner by controlling the relaxation time constant $\tau r$ and the charging time constant $\tau g$ of the toner in compliance with the formula (3). In particular, there exists a good correlation between the charging time constant $\tau g$ and the compressibility which is an index of the toner fluidity. By controlling the compressibility, therefore, the charge rising property can be controlled in compliance with the formula (4).

Moreover, the charge stability can be controlled by controlling the relaxation time constant $\tau r$ of the toner in compliance with the formula (5).

It is desired that the toner concentration (T/D) in the two-component developing agent is determined to lie usually over a range of from 1 to 5% by weight, so that a predetermined maximum amount of electric charge Qmax is obtained.

[EXAMPLE]

The invention will now be described in further detail by way of an Example.

In the Example, various properties were measured as described below.

[Evaluation of Friction Charging Property]

The friction charging property was evaluated by taking into consideration the behavior of the two-component developing agent that comprises the toner and the carrier particles in a copying machine. That is, the toner that is supplied from the hopper is stirred and mixed together with the carrier particles in the developer and is electrically charged. In order to simulate this system, the toner and carrier particles were electrically charged by friction by the method described below.

First, correctly weighed 0.018 g of the toner and 0.582 g of the carrier particles were introduced into a propylene cylindrical container (content of 3 ml) and were left to stand for more than 24 hours. Next, the container was rotated (100 rpm) on a two-roll mill so that the particles were electrically charged by friction. As a result, the toner electrostatically adhered to the peripheries of the carrier particles, and the two-component developing agent was prepared.

Figure 8:
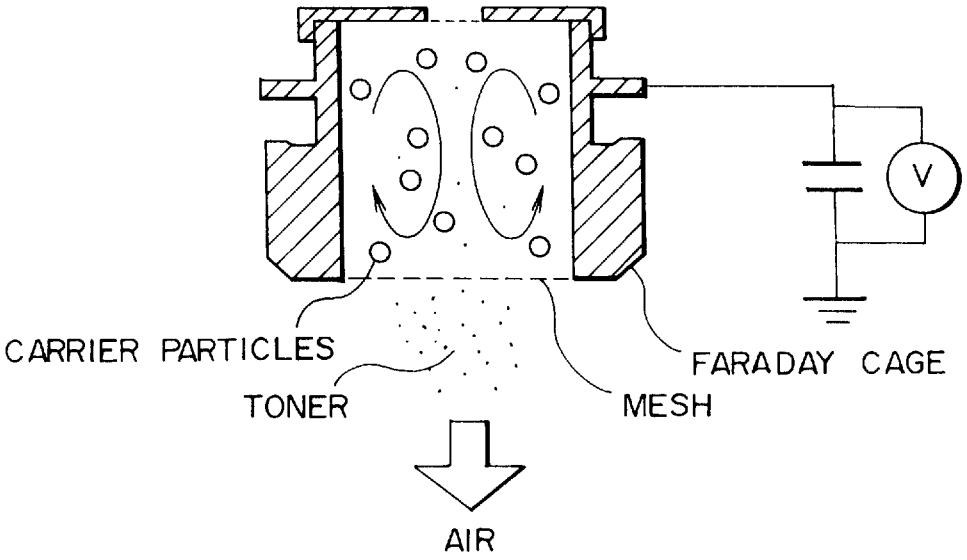
FIG. 8 is a sectional view of a device for measuring the amount of charge (specific charge) of the toner.
Figure 9A:
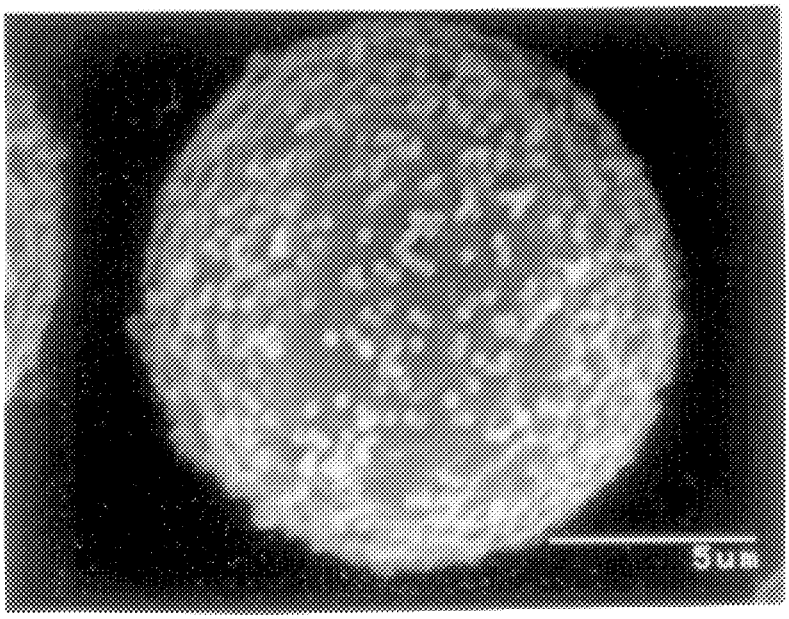
FIGS. 9A–D shows scanning-type electron microphotographs of particle structures of the toners of the embodiment of before the mechanical treatment and after the mechanical treatment.
Figure 9B:
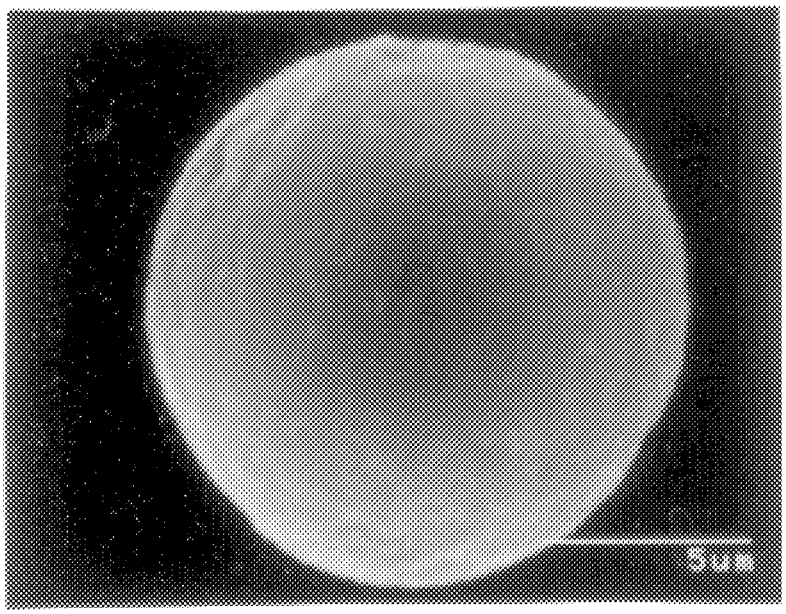
Figure 9C:
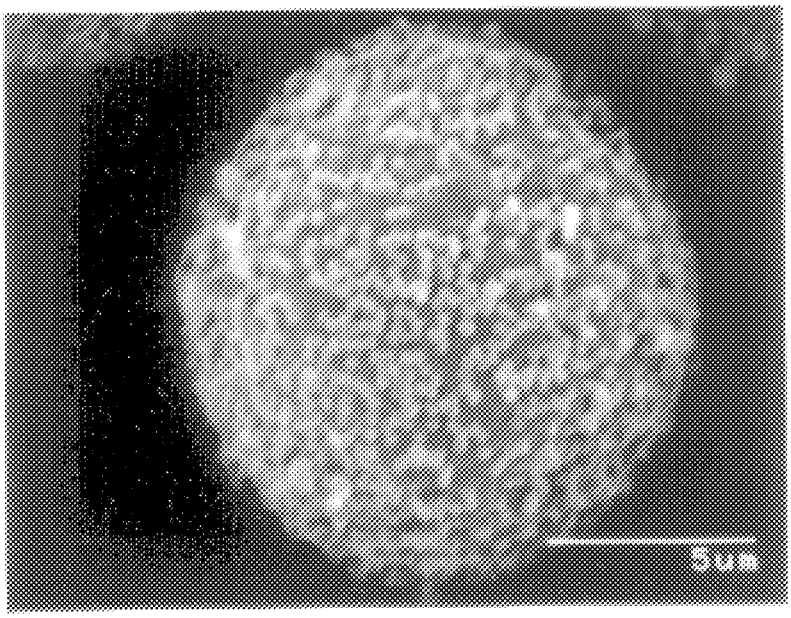
Figure 9D:
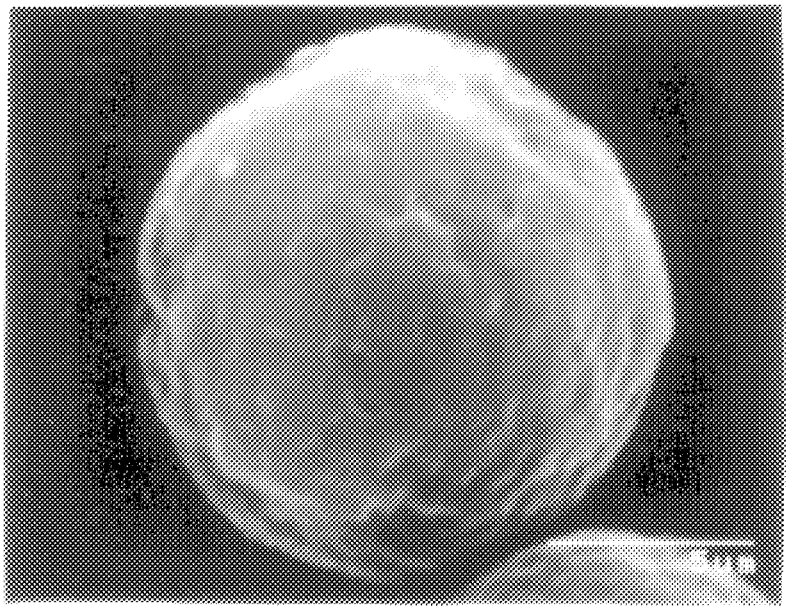

After the container was rotated for a predetermined period of time, the two-component developing agent was readily transferred into a Faraday cage shown in FIG. 8 and the amount of electric charge was found by the blow-off method (experimentally fabricated machine). Experiment was repeated by changing the time for rotating the container in order to evaluate the charge rising property of the toner. Measurement was taken in an environment of a temperature of from 18° to 20° C. and a relative humidity of from 40 to 50%.

[Measurement of Contact Potential Difference of Sample Powder]

The contact potential difference was measured by using the device shown in FIG. 4.

The detector unit was installed in a desiccator containing a silica gel via an electromagnetic shield to prevent noise, and was maintained under the conditions of a temperature of from 18° to 20° C. and a relative humidity of from 9 to 13%. Owing to automatic processing of data and countermeasure against the noise in measuring very small currents, measurement could be taken by using this device maintaining precision of ±0.005 V or smaller.

The contact potential difference of the sample powder was measured in a manner as described below. That is, the lower electrode cell was filled with the sample powder while being electromagnetically vibrated for one minute, and the surface of the powder layer was horizontally cut by using a metal blade of SUS304. After the initial charge of the powder layer was removed, the sample powder was installed on the detector unit and was measured. The initial charge of the powder layer was removed by using a soft X-ray irradiation charge-removing device (IRISYS-SX manufactured by Takasago Netsugaku Kogyo Co.).

The contact potential difference was found by the method described above in compliance with the formula (18).

[Preparation of Toner]

The toner was prepared by mechanically treating a blend of host particles and guest particles that are described below.

The host particles were those (mass median diameter of 15.2 $\mu$m) obtained by removing fine powdery moiety from the spherical polymethyl methacrylate (PMMA) particles (MX-1500 manufactured by Soken Kagaku Co.) by using a centrifugal pneumatic classifier (TC15 manufactured by Nisshin Engineering Co.).

The guest particles were the nearly monodispersed styrene acrylic particles (MP-5000 manufactured by Soken Kagaku Co., mass median diameter of 0.4 $\mu$m).

As a pre-treatment for producing the toner, the host particles and guest particles were pre-mixed together by using a stirrer-mixer (OMD-3 manufactured by Nara Machine Co.).

Various conditions were studied such that the guest particles could be uniformly adhered to the peripheries of the host particles and, as a result, the stirring was effected under the conditions of a rotational speed of 1800 rpm and a treating time of one minute.

After the pre-mixing, the sample powder was mechanically treated by using a high-speed air stream impact system (HYB-1 manufactured by Nara Machine Co.). The rotational speed was 8000 rpm and the treating time was 30 minutes such that the pre-mixed guest particles and host particles were completely solidified but that the surfaces of these particles were not chemically changed due to the treatment.

Table 1 shows the mass fractions R of added guest particles (weight ratio of the guest particles to the host particles), apparent dielectric constants $\epsilon_a$ [$Fm^{-1}$] and apparent resistivities ρ[Ωm] that were measured of the toners that were prepared. The toner in which R=0 represents host particles.

The apparent dielectric constants $\epsilon_a$ [$Fm^{-1}$] shown in Table 1 were found by filling a cell of parallel flat plates maintaining a predetermined distance between electrodes with the powder under the same conditions and by using an electrostatic capacity measuring instrument (MC-118 manufactured by Kuwano Co.). The resistivities [Ωm] were found in compliance with JIS standards (JIS B 9915).

TABLE 1

Properties of Model Toners

| No. | Mass fraction of added quest particles R (–) | Apparent dielectric constant $\epsilon_a$ ($Fm^{-1}$) | Resistivity ρ(Ωm) |
|---|---|---|---|
| 1 | 0 | $1.786 \times 8.85 \times 10^{-12}$ | $1.09 \times 10^{15}$ |
| 2 | 0.025 | $1.643 \times 8.85 \times 10^{-12}$ | $1.11 \times 10^{15}$ |
| 3 | 0.05 | $1.690 \times 8.85 \times 10^{-12}$ | $1.15 \times 10^{15}$ |
| 4 | 0.10 | $1.548 \times 8.85 \times 10^{-12}$ | $1.17 \times 10^{15}$ |
| 5 | 0.15 | $1.607 \times 8.85 \times 10^{-12}$ | $1.16 \times 10^{15}$ |
| 6 | 0.20 | $1.732 \times 8.85 \times 10^{-12}$ | $1.20 \times 10^{15}$ |

FIGS. 9A , 9B, 9C and 9D are scanning-type electron microphotographs of toners of R=0.05 and R=0.15 of before and after the mechanical treatment. It will be understood from the observation of these photographs that the guest particles nearly homogeneously adhered to the peripheries of the host particles due to pre-mixing, and are nearly uniformly and densely applied onto the surfaces of the host particles due to the mechanical treatment.

[Preparation of the Carrier]

The carrier particles were prepared according to a procedure mentioned below. That is, ferrite core particles (produced by Dowa Teppun Co., a mass median diameter of 88.1 μm, a specific weight of 4.8) were coated with an electron-attractive vinylidene fluoride resin (CA-16 produced by Daikin Kogyo Co.) by using a fluidized layer coating apparatus (SPIR-A-FLOW produced by Froint Sangyo Co.), and were cured in an oven maintained at a predetermined temperature. The resin coating rate (weight ratio of the resin to the carrier core particles) of the prepared carrier particles was determined to be 0.32% by weight by using a carbon analyzer (EMIA-110 manufactured by Horiba Seisakusho Co.). Furthermore, the apparent dielectric constant $\epsilon_a$ [$Fm^{-1}$] and the resistivity ρ[Ωm] were measured to be $\epsilon_a$=6.89×8.85×$10^{-12}$ [$Fm^{-1}$] and ρ=8.78×$10^3$ Ωm.

[Measured Results of Charge Rising Properties and Analysis of Charge Curves]

FIG. 2 illustrates changes in the specific charges Q [μC/g] of the toners of Table 1 with respect to the friction time [sec]. All toners acquire their maximum values Q [μC/g] after the passage of predetermined periods of time and then the values decrease. It will further be understood that the time for arriving at the maximum value Q max [μC/g] increases with an increase in the mass fraction R of the added guest particles R. In FIG. 2, the solid lines were drawn along the points plotted in compliance with the formulas (14) and (15), and the calculated values were in good agreement with the measured values.

Figure 10:
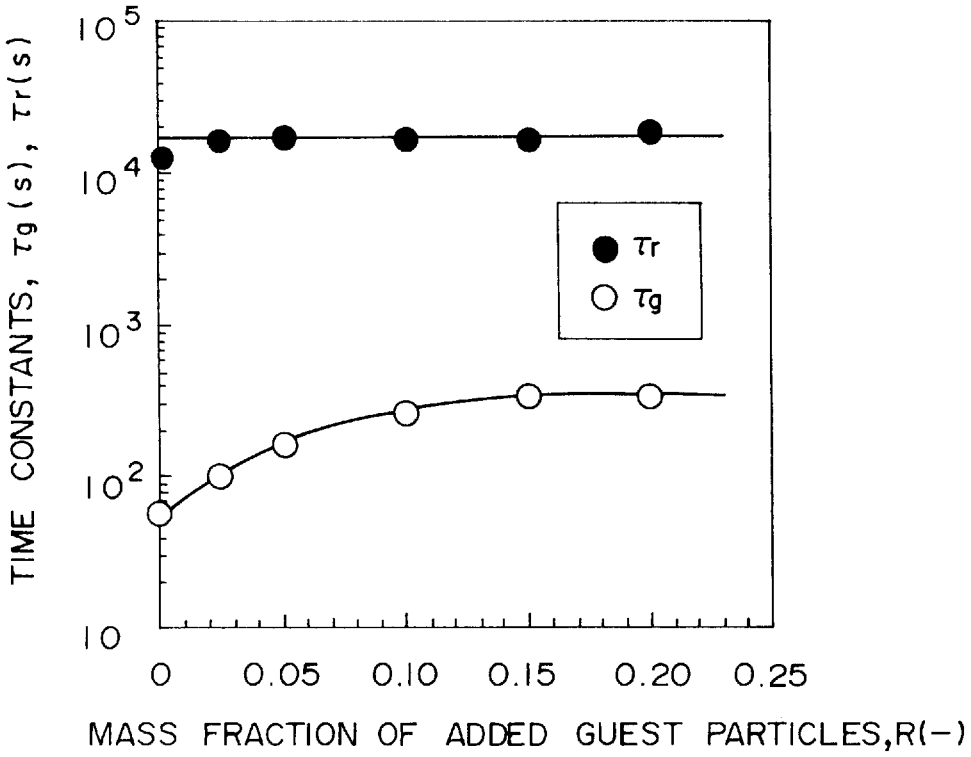
FIG. 10 is a graph illustrating a relationship among the relaxation time constant $\tau r$ of the toner, the charging time constant $\tau g$ of the toner and the mass fraction R of the added guest particles.

Next, the relaxation time constant τr[s] and the charging time constant τg [s] were studied. Since the inclinations of the charge rise shown in FIG. 2 were in compliance with the formula (4), the charging time constant τg was found by an inverse operation. FIG. 10 illustrates a relationship among the relaxation time constant τr, charging time constant τg and mass fraction R. The relaxation time constant τr changes very little irrespective of a change in the mass fraction R but the charging time constant τg increases with an increase in the mass fraction R.

In order to clarify this tendency of the charging time constant τg, the charge rising property was studied. As expressed by the formula (9), the charging time constant τg is related to the frequency of contact. Therefore, its relationship to the fluidity of the toner was examined. FIG. 3 shows a relationship between the charging time constant τg of the toner and the compressibility C [%] that is an index of the fluidity of the powder measured by using a powder tester (PT-E manufactured by Hosokawa Micron Co.). There exists a good correlation between the charging time constant τg and the compressibility C [%]. It was found that the times until maximum values were reached of the six kinds of toners shown in FIG. 2 varied depending upon the fluidity of the toners. This is presumably due to the fact that the frequency of contact to the carrier particles increases when the toner exhibits a good fluidity.

[Measured Results of the Contact Potential Difference and Analysis of Maximum Amount of Charge]

Figure 11:
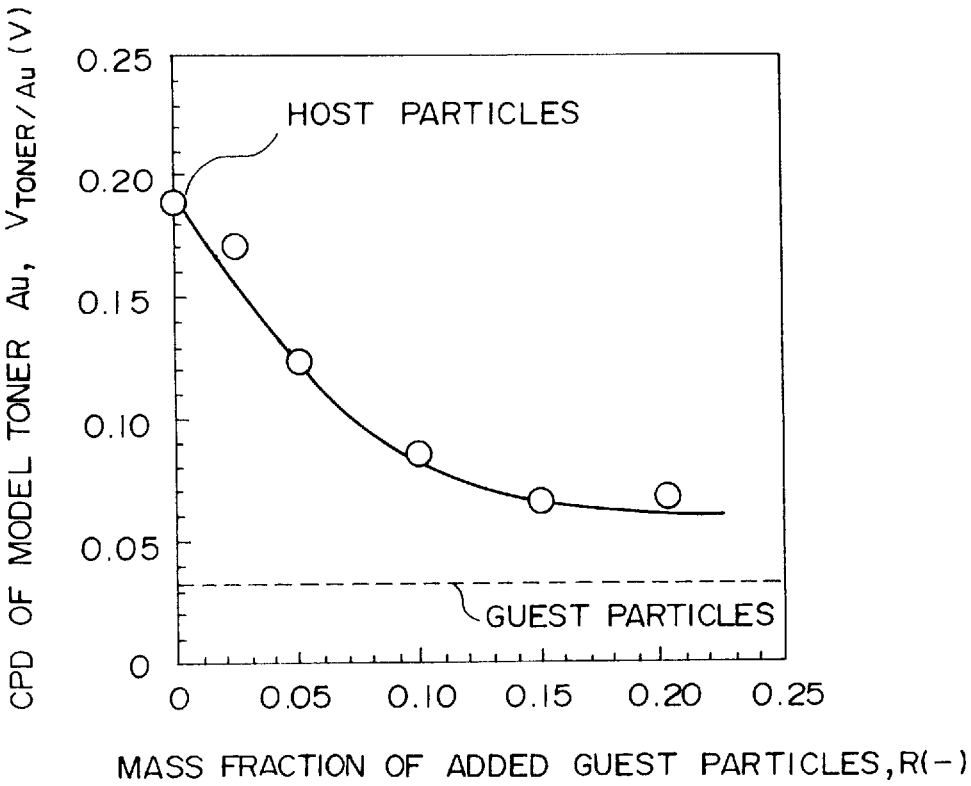
FIG. 11 is a graph illustrating a relationship between the contact potential difference VT/Au of the toner and the mass fraction R of the added guest particles in the toner.

FIG. 11 illustrates a relationship between the contact potential difference $V_{T/Au}$ [V] to Au electrode of the toner measured by using the device shown in FIG. 4 and the mass fraction R. It will be understood that the contact potential difference of the host particles continuously change with an increase in the mass fraction R and approaches the contact potential difference of the guest particles. As will be understood from the SEM photographs of the toners shown in FIG. 9, this can be attributed to that the surfaces of the host particles are coated with the guest particles as the mass fraction R increases.

Furthermore, the contact potential difference $V_{C/Au}$ [V] to Au electrode of the carrier particles was separately measured to be −0.167 V.

FIG. 1 illustrates a relationship between the maximum amount of electric charge Qmax [μC/g] of when the toner is electrically charged by friction by the carrier particles and the contact potential difference $V_{T/C}$ of the toner to the carrier particles. It will be understood that the relationship between the maximum amount of electric charge Qmax and the contact potential difference is represented by a straight line passing through an origin for all sample powders.

The friction charging properties between the toner and the carrier particles were studied, and the following conclusions were obtained.

(1) The specific charge of the toner reaches a maximum value after rubbed by the carrier particles for a predetermined period of time and, then, decreases. The time for reaching the maximum value increases with an increase in the mass fraction of the added guest particles.

(2) The experimental results of charge rising properties of the toner and the carrier particles can be explained by a charge model formula by taking the frequency of contact between the two into consideration. The charge stability varies depending upon the relaxation time constant.

(3) There exists a good correlation between the charging time constant and the fluidity of the toner. Therefore, the charge rising property of the toner can be controlled relying upon the relaxation time constant and the fluidity.

(4) The relationship between the maximum specific charge of the toner and the contact potential difference of the toner to the carrier particles is represented by a straight line that passes through an origin. Therefore, the maximum amount of charge of the toner can be controlled by changing the contact potential difference of the toner to the carrier particles by some means.

According to the present invention, a combination of a toner and a carrier for obtaining a predetermined maximum amount of electric charge can be determined based upon the contact potential difference ($V_{T/C}$) of the toner to the carrier, a desired charge rising property of the toner can be obtained based upon the relaxation time constant ($\tau r$) of the toner and the compressibility of the toner, and a desired charge stability of the toner can be obtained based upon the relaxation time constant ($\tau r$) of the toner.

We claim:

1. A method of electrically charging a two-component developing agent by the friction of a toner and a carrier, wherein electric charge of the two-component developing agent is controlled by combining the toner and the carrier so as to substantially satisfy the following formula (1), $$Q\max = \frac{K \times V_{T/C}}{1 + (\tau g/\tau r)} \quad (1)$$

wherein Qmax is a maximum amount of electric charge ($\mu$C/g) of the toner, $V_{T/C}$ is a contact potential difference (V) of the toner to the carrier, $\tau r$ is a relaxation time constant (sec) of the toner, $\tau g$ is a charging time constant (sec) of the toner, and k is a coefficient (F) determined depending upon the kinds of the toner and the carrier.

2. A method according to claim 1, wherein when $\tau g/\tau R \ll 1$, said formula (1) is approximated by the following formula (2), $$Qmax = k \times V_{T/C} \quad (2).$$

3. A method of electrically charging a two-component developing agent by the friction of a toner and a carrier, electric charge of the two-component developing agent is controlled by selecting the toner so as to substantially satisfy the following formula (3), $$\Delta Q = Q\max \times \left( \frac{1}{\tau r} + \frac{1}{aC + b} \right) \quad (3)$$

or the following formula (4), $$\Delta Q = Q\max \times \left( \frac{1}{\tau r} + \frac{1}{\tau g} \right) \quad (4)$$

wherein $\Delta Q$ is a charge rising property ($\mu C \times g^{-1} \times sec^{-1}$) of the toner, $\tau r$ is a relaxation time constant (sec) of the toner, C is a compressibility (%) of the toner as measured by using a powder tester, Qmax is a maximum amount of electric charge ($\mu$C/g) of the toner, a and b are constants determined depending upon the kinds of the toner and the carrier, and $\tau g$ is a charging time constant (sec) of the toner.

4. A method of electrically charging a two-component developing agent by the friction of a toner and a carrier, electric charge of the two-component developing agent is controlled by selecting the toner so that a decrease Q in the amount of electric charge after t seconds have passed from the start of friction substantially satisfies the following formula (5), $$Q \leqq Q\max \times \exp\left( -\frac{t}{\tau r} \right) \quad (5)$$

wherein Qmax is a maximum amount of electric charge ($\mu$C/g) of the toner and $\tau r$ is a relaxation time constant (sec) of the toner.

* * * * *